US005694954A

United States Patent [19]

Habibi

[11] Patent Number: 5,694,954

[45] Date of Patent: Dec. 9, 1997

[54] HEATED HAIR CURLER WITH ADJUSTABLE DIAMETER AND HEATING UNIT THEREFOR

[76] Inventor: Masood Habibi, P.O. Box 71104, Los Angeles, Calif. 90071

[21] Appl. No.: 540,791

[22] Filed: Oct. 11, 1995

[51] Int. Cl.[6] ..... A45D 7/02; A45D 2/18; A45D 2/36

[52] U.S. Cl. ..... 132/211; 132/222; 132/233; 132/251

[58] Field of Search ..... 132/222, 229, 132/233, 246, 269, 245, 251, 264, 210, 211

[56] References Cited

U.S. PATENT DOCUMENTS

| | | | |
|---|---|---|---|
| 1,892,107 | 12/1932 | Jancke et al. | 132/229 |
| 1,894,431 | 1/1933 | Vaghelatos | 132/229 |
| 1,926,987 | 9/1933 | Durham et al. | 132/222 |
| 1,957,049 | 5/1934 | Lakenbach | 132/222 |
| 2,720,207 | 10/1955 | Bertnett | 132/246 |
| 3,232,300 | 2/1966 | Fisher | 132/39 |
| 3,523,542 | 8/1970 | Eisler | 132/229 |
| 3,590,829 | 7/1971 | Parisi | 132/43 |
| 3,871,388 | 3/1975 | Leoci . | |
| 4,022,225 | 5/1977 | Kauffmann | 132/269 |
| 4,022,226 | 5/1977 | Muenstermann . | |
| 4,270,555 | 6/1981 | Punte | 132/40 |
| 4,456,020 | 6/1984 | van Deursen | 132/34 |
| 4,524,788 | 6/1985 | Pauldine | 132/42 |
| 4,584,462 | 4/1986 | Morrison | 219/222 |
| 4,714,820 | 12/1987 | Morrison et al. | 132/229 |
| 4,856,542 | 8/1989 | Hollenberg et al. | 132/265 |
| 4,911,186 | 3/1990 | Hayden | 132/246 |
| 5,000,200 | 3/1991 | Roberts | 132/245 |
| 5,020,552 | 6/1991 | Hollenberg et al. | 132/265 |
| 5,024,244 | 6/1991 | Brown | 132/270 |
| 5,186,187 | 2/1993 | Roberts | 132/245 |
| 5,293,884 | 3/1994 | Chapman et al. | 132/200 |
| 5,294,777 | 3/1994 | Denhup | 132/229 |
| 5,411,040 | 5/1995 | Forrest | 132/211 |

*Primary Examiner*—Todd E. Manahan
*Attorney, Agent, or Firm*—D'Alessandro & Ritchie

[57] ABSTRACT

A heated adjustable diameter hair curler is formed of a sheet of a flexible material such as a plastic. The sheet has two planar sides. Disposed within the sheet are one or more thermal elements such as thin flexible sheets and/or flexible wires or coils fabricated of thermally conductive material such as metal. One end of the sheet has a curler thermal connector to which are connected the thermal elements. A base thermal connector in a heating unit mates with the curler thermal connector so that a thermally conductive path is formed from the heating unit to the curler thermal connector of the curler. The thermal mass of the thermal elements keeps the Curler heated for some period of time after the curler is removed from the heating unit. By rolling the sheet to form a cylinder so that a portion of the sheet overlaps another portion of the sheet, and clipping the two portions together with a clip such as a bobby pin or the like, the cylinder's shape may be established and held with relative ease and complete adjustability of cylinder diameter. For storage, the sheets may be completely flattened for storage or transport in a very minimal volume. A tapered end may be provided to one end of the sheet so that when the sheet is rolled into a cylindrical form, the step formed at the overlap is reduced or eliminated to avoid imprinting this step onto the hair.

23 Claims, 6 Drawing Sheets

HEATED HAIR CURLER WITH ADJUSTABLE DIAMETER AND HEATING UNIT THEREFOR

BACKGROUND OF THE INVENTION

1. Field of the Invention

The present invention relates to heated hair curlers for curling human hair. More particularly, the invention relates to a novel adjustable apparatus for curling hair at selected diameter curls which provides heat to the hair and may be stored and carried in a small volume. The present invention is also directed to a transportable curler heating unit for use with the aforementioned hair curlers.

2. The Prior Art

Hair curlers are well known. Such devices traditionally comprise a cylinder upon which hair is rolled or curled. Heat and/or hair spray or other hair products are often applied so that the hair takes on the shape of the curler and, when the curler is removed, the hair is still curled. It is often desirable to be able to adjust the diameter of a curler so that a small number of curlers may offer the capability of curling at a number of diameters. A number of adjustable diameter curlers are thus known in the art. U.S. Pat. No. 4,456,020 to van Deursen teaches an adjustable diameter curler. The van Deursen device comprises a pair of telescoping elongated tubes axially and rotatably movable relative to one another. A pair of nested larger diameter end caps is secured at each end of each tube with the roller generally resembling a spool. Each pair of end caps includes a first cap with spiralled cam slots radiating from its center and a second cap nested in the first with a plurality of corresponding or equal number of straight cam slots radiating from its center. The nesting caps are rotatable relative to each other and the caps at each end are connected together by a plurality of toothed elongated curler segments. Each segment has structure at each end cooperating with the cap slots such that by rotating the end caps in opposite directions the segments are radially cammed to change the curler roller diameter. Additional structure locks the cap rotation at any desired roller diameter.

U.S. Pat. No. 5,186,187 to Roberts teaches another adjustable diameter curler. Roberts' device provides for the use of a cylindrical tube rolled from a rectangular perforated sheet of flexible material, the sheet having an outer edge which overlaps a portion of the tube. The tube has a pair of opposing transverse edges, each of which is engaged within a spiral groove formed in opposing caps. The caps are rotationally mounted on an elongated shaft, such that rotation of the disks causes advancement of the transverse edges within the spiral groove, changing the diameter of the outer tube, as desired.

U.S. Pat. Nos. 5,020,552 and 4,856,542 to Hollenberg et al. teach a radially expandable hair curler comprising a generally cylindrical hollow body, a detachable holding strap stretching from one longitudinal end of the body to the other, and internal mechanical devices for expanding and contracting the curler body.

U.S. Pat. No. 4,270,555 to Punte teaches a hair curler that provides for a plurality of stages of hair curling with increasing wave lengths along the length of the hairs of the head. The hair curler may be used on short hair or very long hair. The multi-stages provide for a selectivity of lengths for short hair. The hair curler consists of a plurality of removably insertable curler components that nest one within the other in a manner similar to a telescoping mechanism. An elastic tie provides a means for securing the plurality of removably insertable components together and, at the same time, holds the hair in place on the curler. A port hole in one end provides a means for applying wave solution to the hair rolled on the interior of the roller, with communicating slots to permit the solution to seep through to the hair at the periphery of the spiraling rolls of hair.

U.S. Pat. No. 5,000,200 to Roberts provides for the use of a cylindrical tube rolled from a rectangular sheet of flexible material, the sheet having an outer edge which overlaps a portion of the tube. The tube has a pair of opposing transverse edges, each of which is engaged within a spiral groove formed in opposing end caps. The end caps are rotationally mounted on an elongated shaft, such that rotation of the caps causes advancement of the transverse edges within the spiral grooves, changing the diameter of the outer tube, as desired.

U.S. Pat. No. 3,232,300 to Fisher teaches an adjustable diameter hair curler formed of a sheet of soft plastic having an array of holes and a line of snap-type fasteners. The snaps mate with and penetrate a line of holes in the array to hold the sheet in the form of a cylinder. Diameter adjustment is accomplished by selecting another line of holes to apply the snaps to.

Non-adjustable fixed-diameter cylindrical hair curlers are known which include hook-type fasteners on the outer portion of the cylinder for engaging hair.

U.S. Pat. No. 4,584,462 to Morrison teaches a transportable heating unit for hair curlers which utilizes a heat sink core to heat a plurality of hair curler elements stored longitudinally adjacent to the heat sink core. The heat must pass through an insulating layer of the curler elements.

While the foregoing devices are fit for their intended purposes, there is room for improvement in portable, adjustable diameter heated hair curlers.

SUMMARY OF THE INVENTION

The present invention is directed to a novel heated adjustable diameter hair curler which is extremely lightweight, portable, and suitable for travel. The novel adjustable curler comprises a sheet of a flexible material such as a plastic. The sheet has a first planar side and a second planar side opposite said first planar side. Disposed within the sheet are one or more thermal elements such as thin flexible sheets and/or flexible wires or coils fabricated of thermally conductive material such as metal. One end of the sheet has a curler thermal connector to which are connected the thermal elements. The curler thermal connector on the sheet is preferably a recessed portion which fits over a mating projecting portion of the heating unit. A reversed configuration may also be used as may any configuration which provides a close fit so that a good thermally conductive path is formed from the heating element to the curler thermal connector of the curler. Application of heat from a heat source to the curler thermal connector (heating phase) causes heat to flow principally by thermal conduction to the thermal elements. The thermal mass of the thermal elements keeps the curler heated for some period of time after the curler is removed from the heat source. Preferably the heat source is an electrically powered heating unit having a plurality of mating base thermal connectors to which the curler thermal connectors of a plurality of curlers may simultaneously by engaged. By rolling the sheet to form a cylinder so that a portion of the sheet overlaps another portion of the sheet ("overlap"), and clipping the two portions together with a clip such as a bobby pin or the like, the cylinder's shape may be established and held with relative ease and complete adjustability of cylinder diameter. For storage, the sheets may be completely flattened for storage or transport in a very minimal volume.

According to another aspect of the present invention, a tapered end is provided to one end of the sheet so that when the sheet is rolled into a cylindrical form, the "step" formed at the overlap is reduced or eliminated to avoid imprinting this step onto the hair.

According to another aspect of the present invention, a series of guides or holes are provided through the sheet including a first guide at a first end of the sheet extending horizontally through the sheet and a series of other parallel guides extending horizontally through the sheet, at locations intermediate the two ends of the sheet, so that a clip or pin such as a bobby pin may be used to clip two such guides together at an overlap to hold the cylindrical shape of the curler.

According to another aspect of the present invention, a clip or pin, slidable in the first guide, but not easily removable from the guide and being essentially permanently disposed therein, is provided to clip two guides together at an overlap without the need to use a separate pin or clip.

OBJECTS AND ADVANTAGES OF THE INVENTION

Accordingly, it is an object of the present invention to provide a novel hair curler.

It is a further object of the present invention to provide a novel hair curler which is heated and completely adjustable in diameter, yet comprises no moving parts.

Another object of the present invention is to provide an adjustable diameter heated curler which may be stowed, along with its heating element, in a small volume suitable for travel.

Yet another object of the present invention is to provide a heating unit for adjustable diameter hair curlers which heats primarily by conduction through a metal path to metal thermal elements embedded within the curlers.

These and many other objects and advantages of the present invention will become apparent to those of ordinary skill in the art from a consideration of the drawings and ensuing description of the invention.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

The use of hair curlers to curl hair for cosmetic purposes is well known in the art. Such prior art curlers offer a number of drawbacks. When fixed-diameter curlers are used, they are frequently voluminous to store or transport as a large number of curlers may be needed at any one time, and a complete set at each desired diameter may be required for full flexibility. Adjustable diameter curlers are often complex mechanisms which may be difficult to manipulate and which often do not store in a flat configuration so that storage in a small volume is possible. Such small volume storage is highly desirable for travel, or servicing customers away from the hair salon. The present invention resolves these drawbacks with elegant simplicity.

Figure 1:
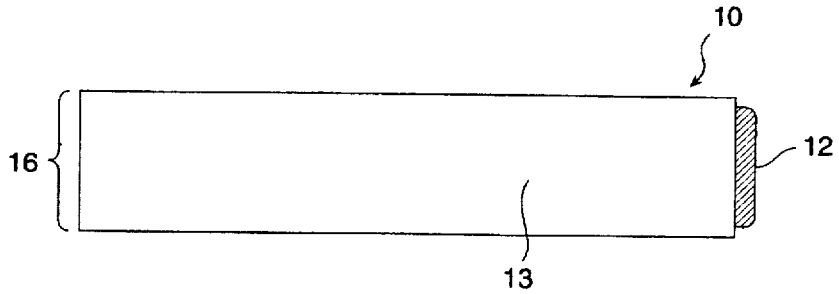
FIG. 1 is a top plan view of the hair curler apparatus according to a presently preferred embodiment of the present invention.
Figure 2:
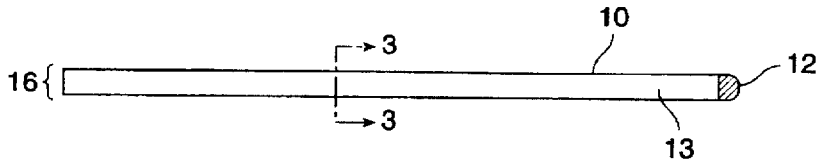
FIG. 2 is a side view of the hair curler apparatus according to a presently preferred embodiment of the present invention.
Figure 3A:
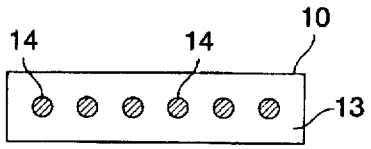
FIG. 3A is a cross-sectional view taken along line 3—3 of FIG. 2 showing the inside structure of the hair curler apparatus according to a presently preferred embodiment of the present invention.
Figure 3B:
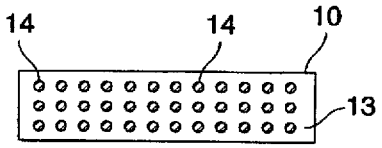
FIG. 3B is a cross-sectional view taken along line 3—3 of FIG. 2 showing the inside structure of an alternative preferred embodiment of the hair curler apparatus according to the present invention.
Figure 3C:
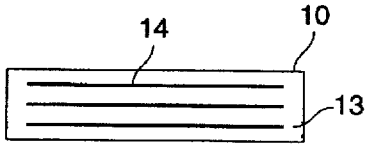
FIG. 3C is a cross-sectional view taken along line 3—3 of FIG. 2 showing the inside structure of an alternative preferred embodiment of the hair curler apparatus according to the present invention.
Figure 3D:
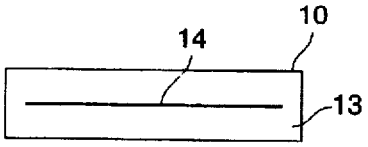
FIG. 3D is a cross-sectional view taken along line 3—3 of FIG. 2 showing the inside structure of an alternative preferred embodiment of the hair curler apparatus according to the present invention.

According to a presently preferred embodiment of the present invention, the adjustable curler comprises a thin flexible rectangular sheet 10 as shown in FIGS. 1 and 2. At one end of sheet 10 is a curler thermal connector 12 which may be a solid piece of copper as shown, or may be configured in other ways, such as a plurality of metallic ends, or the like. Preferably attached to the curler thermal connector 12 are a plurality of thermal elements 14 embedded within sheet 10. Various configurations of thermal elements 14 are shown in FIGS. 3A, 3B, 3C and 3D. Such elements may be rods or wires or sheets of coils or thermally conductive material which is flexible and thin so that they may be embedded within sheet 10 and not significantly impede the flexibility of sheet 10. Stranded copper wire may be used as may thin (less than about 0.125 inch diameter) solid copper wire and strands and sheets of other metals which are suitably ductile and/or flexible. Coils of wire may also be used.

Figure 7:
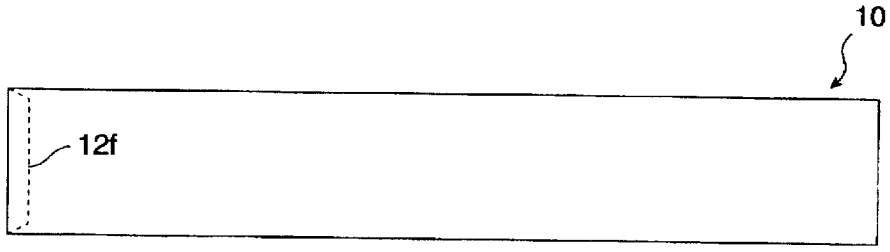
FIG. 7 is a top plan view of the hair curler apparatus according to a presently preferred embodiment of the present invention showing female curler thermal connectors **12*f*** at one end of the hair curler sheet.
Figure 8:
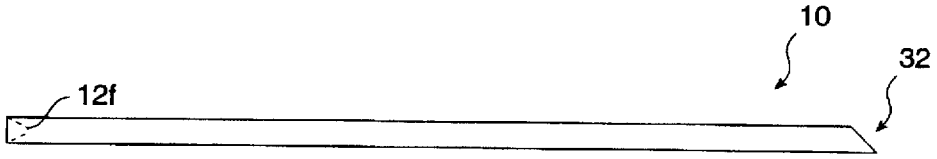
FIG. 8 is a side view of the hair curler apparatus of FIG. 7 according to a presently preferred embodiment of the present invention.
Figure 9:
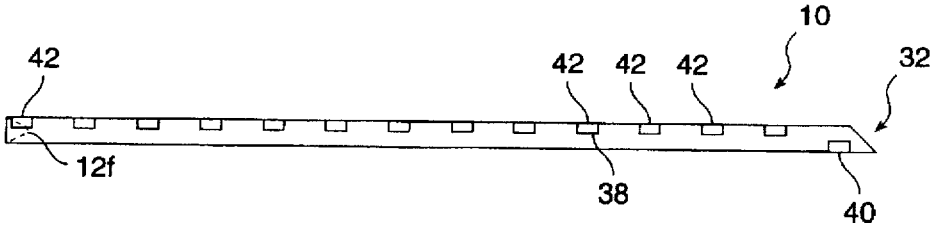
FIG. 9 is a side view of an alternative embodiment of the hair curler apparatus of FIG. 7.

Curler thermal connector 12 is shown as a male connector in FIGS. 1–2. It may also preferably be a female receptacle as shown in FIGS. 7–9 at **12*f***.

In operation, thermal elements 14 are bonded to curler thermal connector 12 (or **12*f*) and sealed within sheet 10 to form an elongate sheet (which is preferably, but need not be rectangular in shape) having a curler thermal connector 12 at one end. Curler thermal connector 12 is then placed in contact with a hot surface which causes the entire body of the curler 16 to heat up to nearly the temperature of the hot surface primarily by means of thermal conduction through curler thermal connector 12 to thermal elements(s) 14. Once heated, curler 16 is formed into a cylindrical shape and locked in place with a clip 18** such as a common bobby pin. Hair is rolled around it and allowed to set in a conventional manner.

Sheet 10 is preferably fabricated of a flexible plastic or rubber material which can withstand repeated thermal cycling without failure. The maximum temperature that sheet 10 attains should generally be comfortably less than about 100 degrees centigrade. Materials such as silicone rubber, silicone foam rubber and similar materials well known to those of ordinary skill in the art are suitable for the formation of the body 13 of the sheet 10.

It is desirable that sheet 10 be flexible, yet resilient, so that when bent, it attains a round shape rather than a folded shape. This can be achieved by either or both of a choice of heating element (12) materials (such as spring steel, or the like) and the insulating body material 13. Where a non-resilient body material 13 is selected, thin spring steel, or a similar resilient material should be included along the length of the curler sheet to provide resilience to the assembly as a whole. The spring steel may also be part or all of the thermal elements.

Figure 6A:
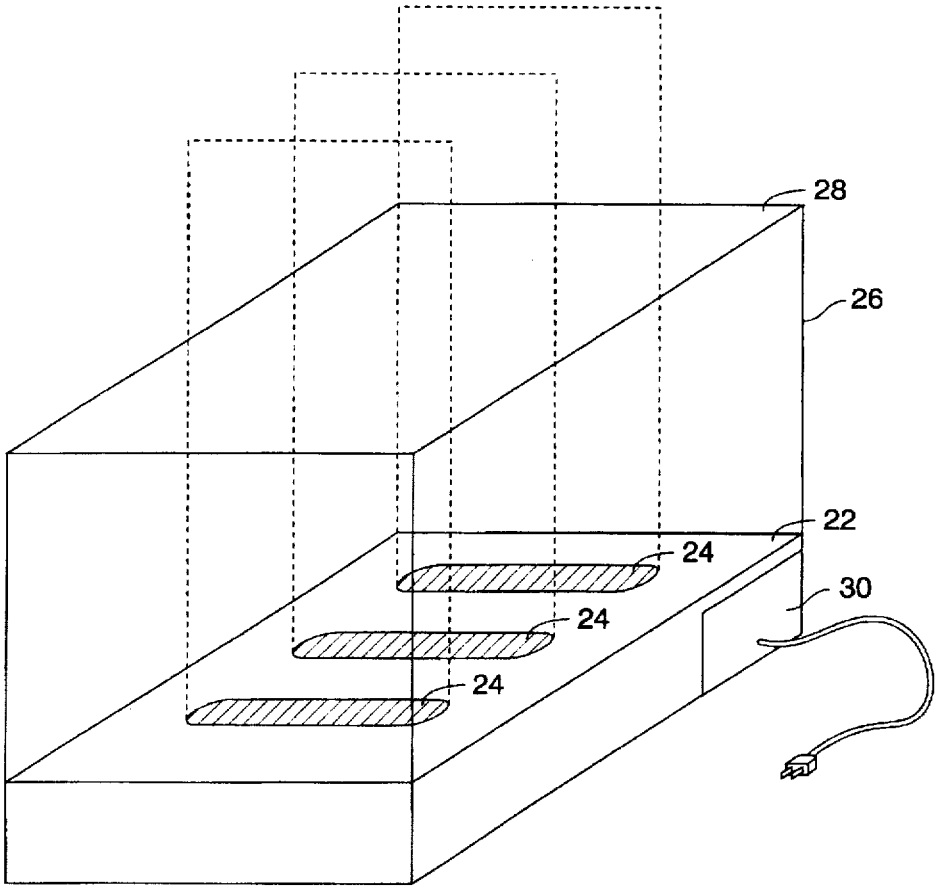
FIG. 6A is a perspective view of the heating station for the adjustable diameter hair curler according to a first presently preferred embodiment of the present invention.
Figure 6B:
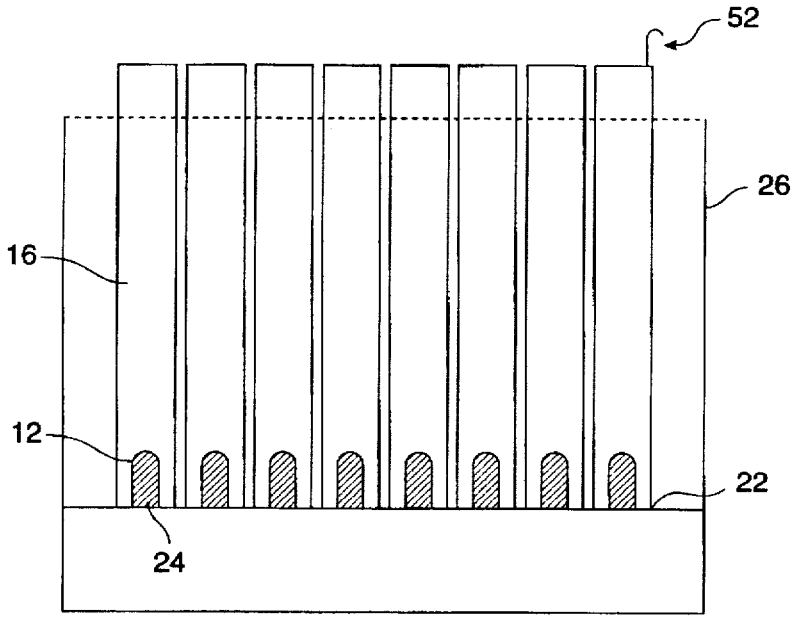
FIG. 6B is a front elevational drawing of the heating station for the adjustable diameter hair curler according to a second presently preferred embodiment of the present invention.

The heating element for the curler is preferably a temperature-controlled surface 22 as shown in FIGS. 6A and 6B which includes a plurality of base thermal connectors 24 to which the curler thermal connectors 12 of curler elements 16 may mate. A box-like housing 26 with or without a top surface 28 may be provided to protect hot surface 22 from contact with fingers, etc. while it is hot. Any method of heating surface 22 may be used, however, an electrical system including a conventional thermostat control 30 to avoid over-heating is presently preferred for safety. The curlers may be stowed flat within the heating unit for minimum volume storage and carrying. In FIG. 6A, a configuration where the base thermal connectors are of female gender and the curler thermal connectors 12 are of male gender is shown. In FIG. 6B the opposite arrangement is shown. The arrangement of FIG. 6B is presently more preferred as it minimizes the likelihood of finger contact with the hot metal curler thermal connector 12 of the curler sheet 16.

Figure 4:
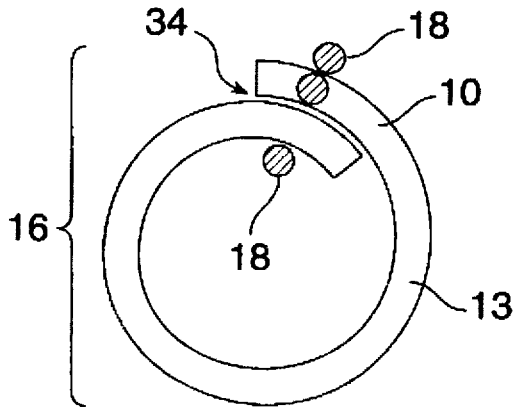
FIG. 4 is a view looking down the cylindrical form of the adjustable diameter hair curler according to a presently preferred embodiment of the present invention.
Figure 5:
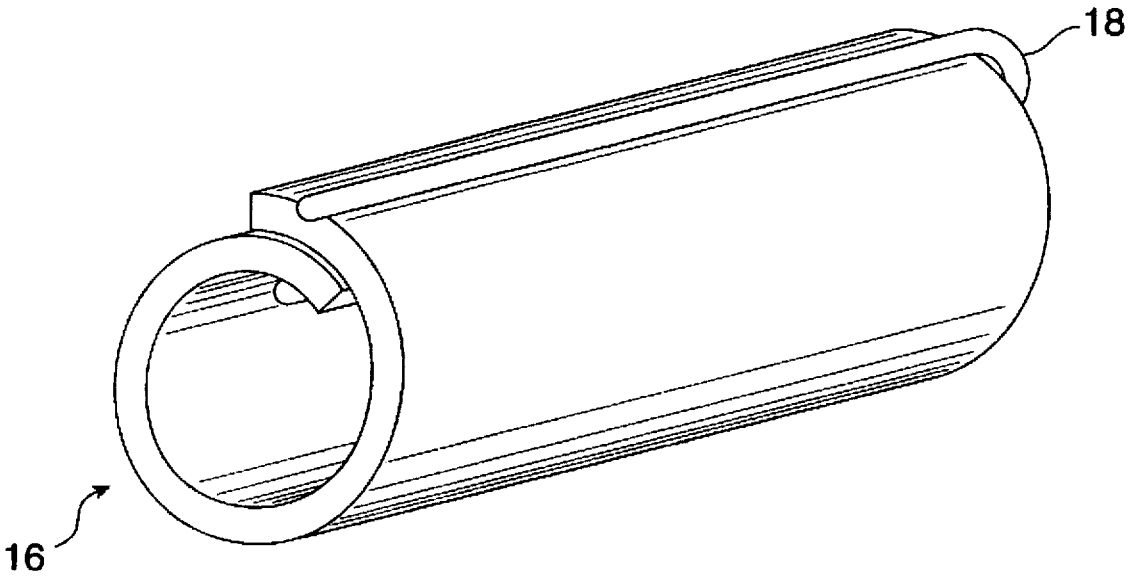
FIG. 5 is a perspective view of the cylindrical form of the adjustable diameter hair curler according to a presently preferred embodiment of the present invention.
Figure 10:
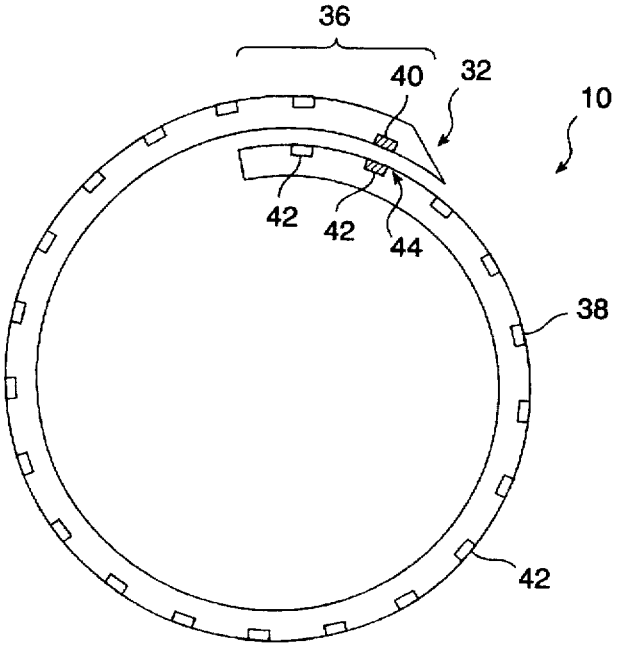
FIG. 10 is a side view of the hair curler apparatus of FIG. 9 as it would be used formed into a cylindrical shape.

According to another aspect of the present invention, a tapered end 32 as shown in FIGS. 8, 9 and 10 is provided to one end of the sheet so that when the sheet is rolled into a cylindrical form, the "step" (34 in FIG. 4) formed at the overlap (36 in FIG. 10) is reduced or eliminated to avoid imprinting this step onto the hair.

According to another aspect .of the present invention, a series of guides or holes (38 in FIGS. 9 and 10) are provided through the sheet including a first guide (40 in FIGS. 9 and 10) at a first end of the sheet extending horizontally through the sheet and a series of other parallel guides 42 extending horizontally through the sheet, at locations intermediate the two ends of the sheet, so that a clip or pin such as a bobby pin 44 may be used to clip two such guides together at an overlap 36 as shown in FIG. 10 to hold the cylindrical shape of the curler.

Figure 11:
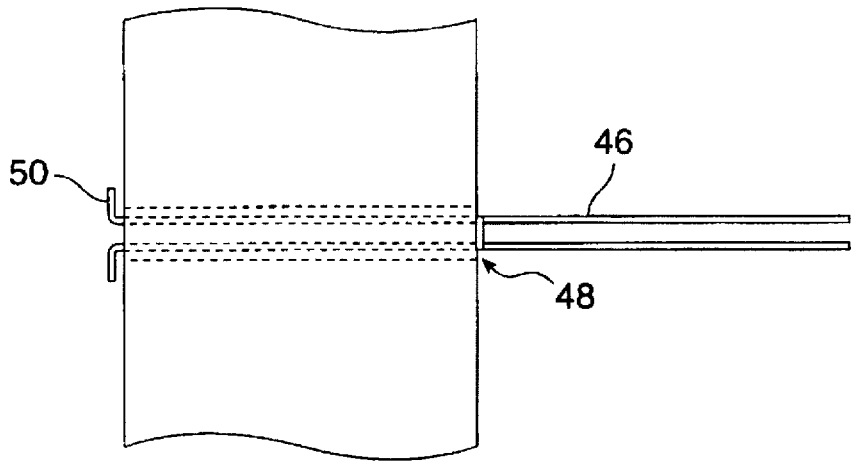
FIG. 11 is a top plan view showing the permanent clip 46 installed in a guide of the hair curler sheet.
Figure 12:
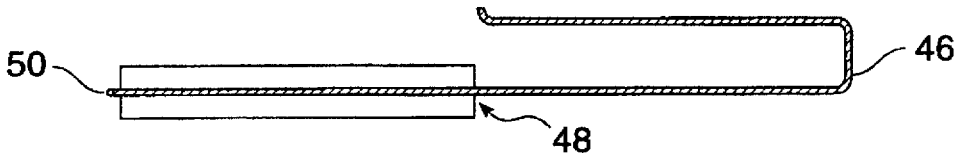
FIG. 12 is a cross sectional view showing the permanent clip 46 installed in a guide of the hair curler sheet.
Figure 13:
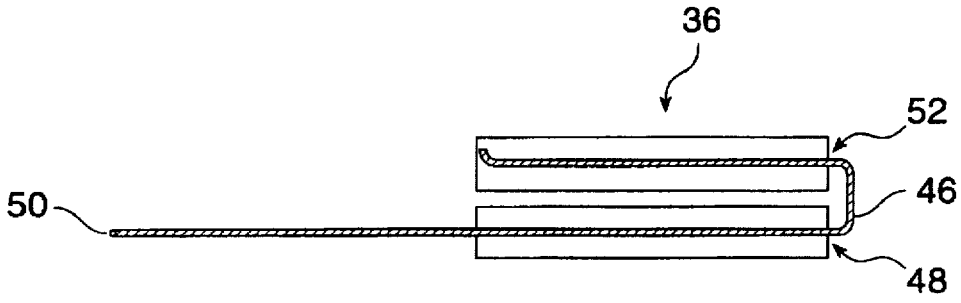
FIG. 13 is a cross sectional view showing the permanent clip 46 installed in a guide of the hair curler sheet and holding that guide to another guide.

According to another aspect of the present invention shown at FIGS. 11–13, a pin 46, slidable in the first guide 48, but not easily removable from the guide, and preferably held in place by a bent portion 50, is provided to clip two guides 48, 52 together at an overlap (36 in FIG. 10 and 13) without the need to use a separate pin or clip.

Another feature which may be incorporated if desired is to attach a pull tab (52 in FIG. 6B), preferably of a fabric material, by gluing, or other conventional means, to the side opposite the curler thermal connector 12 of sheet 10. This aids in removing the sheets 10 from the heating unit without exposing the skin of the hand to the elevated temperature of the sheet.

Figure 14:
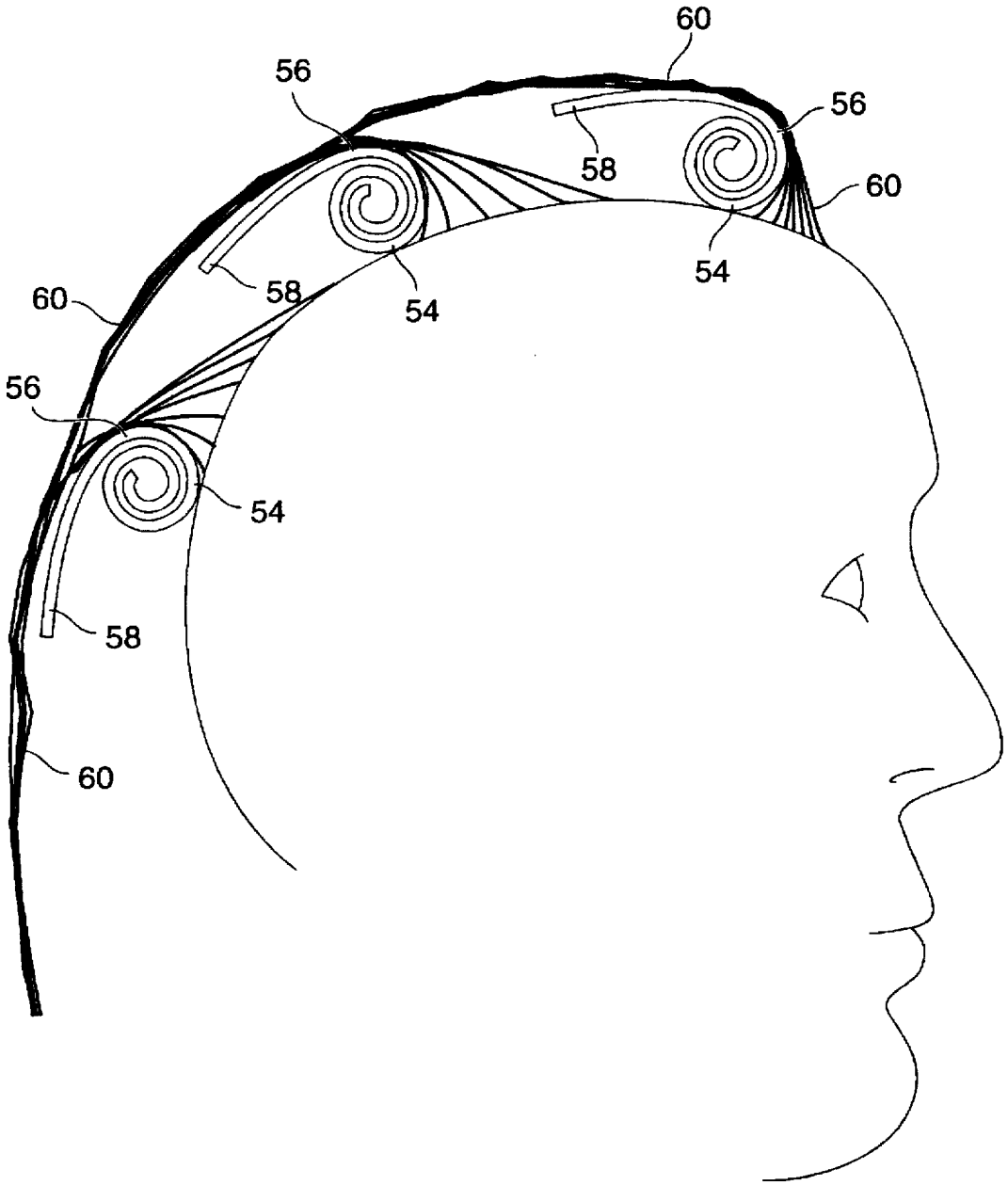
FIG. 14 is a view showing an alternative method of use of the adjustable diameter hair curler according to another preferred embodiment of the present invention showing hair pulled up by the curler and draped over a tail portion of the curler.

Turning now to FIG. 14, the present invention may be used in a novel way to achieve a novel effect. The adjustable curlers 54 may be configured as shown in FIG. 14 so that they comprise a rounded portion 56 and a tail 58. This configuration provides for lifting the hair 60 against the roots while the tail keeps the hair 60 straight, resulting in full hair with straight ends. Conventional round curlers curl the entirety of the hair and are not generally used where straight hair is desired.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. An adjustable diameter hair curler comprising:

a flat sheet of a flexible material, said sheet having a first planar side, a second planar side, and a first and a second end;

a highly thermally conductive curler thermal connector disposed at said first end of said flat sheet for thermal connection during a heating phase to a heat source; and at least one thermally conductive thermal element thermally connected to said curler thermal connector and disposed within said sheet.

2. An adjustable diameter hair curler according to claim 1 further comprising:

means for removably connecting a first portion of said sheet to a second portion of said sheet to form a cylindrical curler.

3. An adjustable diameter hair curler according to claim 2 further comprising a tapered end disposed at said second end.

4. An adjustable diameter hair curler according to claim 3 further comprising a pull tab disposed at said second end.

5. An adjustable diameter hair curler according to claim 1 wherein said at least one thermally conductive heating element comprises a plurality of metal wires.

6. An adjustable diameter hair curler according to claim 5 wherein said plurality of metal wires are flexible stranded copper wires.

7. An adjustable diameter hair curler according to claim 5 wherein said plurality of metal wires are flexible solid copper wires.

8. An adjustable diameter hair curler according to claim 1 wherein said at least one thermally conductive heating element comprises a planar element comprising a metal.

9. An adjustable diameter hair curler according to claim 8 wherein said planar element comprises copper.

10. An adjustable diameter hair curler according to claim 1 wherein said at least one thermally conductive heating element comprises a plurality of planar elements formed of a metal.

11. A heated and adjustable hair curler system comprising:

a plurality of curler elements, each of said curler elements including:

a flat sheet of a flexible material, said sheet having a first planar side, a second planar side, a first end and a second end;

a highly thermally conductive curler thermal connector disposed at said first end of said flat sheet;

at least one thermally conductive heating element thermally connected to said curler thermal connector and disposed within said sheet;

a curler heater, including:

A heated surface having at least one base thermal connector for engaging at least one of said curler thermal connectors, said heated surface heated by a heating element.

12. A heated and adjustable hair curler system comprising:

a plurality of curler elements, each of said curler elements including:

a flat sheet of a flexible material, said sheet having a first planar side, a second planar side, a first end and a second end;

a highly thermally conductive curler thermal connector disposed at said first end of said flat sheet;

at least one thermally conductive heating element thermally connected to said curler thermal connector and disposed within said sheet;

a curler heater, including:

A heated surface having at least one base thermal connector for engaging at least one of said curler thermal connectors, said heating surface electrically heated by a heating element operating under the control of a thermostat so as to keep the temperature of said heated surface within a predetermined range.

13. A hair curler system according to claim 12 wherein at least one of said flat sheets includes a tapered end at said second end.

14. An adjustable diameter hair curler comprising:

a flat sheet of a flexible material of a first maximum thickness, said sheet having a first planar side, a second planar side opposite said first planar side, and a first and a second end disposed opposite said first end;

a highly thermally conductive curler thermal connector disposed at said first end; and at least one thermally conductive heating element thermally connected to said curler thermal connector and disposed within said sheet, said sheet with said at least one heating element disposed therein being resilient.

15. A hair curler according to claim 14 wherein said flat sheet has, at its second end, a thickness taper from said first maximum thickness to zero thickness.

16. A hair curler according to claim 15 further comprising a plurality of guides disposed horizontally through said sheet and arranged so that a pair of selected guides may be clipped together to form the hair curler into a cylindrical shape.

17. A hair curler according to claim 16 further comprising a clip permanently and slidably disposed in a first of said pair of selected guides for clipping a second of said pair of selected guides to said first of said pair of selected guides.

18. A hair curler according to claim 17 further comprising a pull tab permanently attached to said sheet and disposed at said second end thereof.

19. A hair curler according to claim 14 further comprising a plurality of guides disposed horizontally through said sheet and arranged so that a pair of selected guides may be clipped together to form the hair curler into a cylindrical shape.

20. A hair curler according to claim 19 further comprising a clip permanently and slidably disposed in a first of said pair of selected guides for clipping a second of said pair of selected guides to said first of said pair of selected guides.

21. A hair curler according to claim 20 further comprising a pull tab permanently attached to said sheet and disposed at said second end thereof.

22. A method for applying hair to an adjustable diameter curler wherein said adjustable diameter curler includes a flat sheet of flexible material, said method comprising the steps of:

rolling said sheet with one hand onto a shape including a cylindrical portion and a tail portion, said cylindrical portion including an overlap;

clipping said sheet to itself at said overlap;

lifting said hair away from the scalp;

placing said curler under said hair so that the tail portion of said curler extends from said cylindrical portion in a direction away from the roots of said hair and downward towards the scalp; and clipping the hair to the curler.

23. A method according to claim 22, further comprising:

clipping the hair to the curler both at said cylindrical portion and at said tail portion.

* * * * *